United States Patent [19]

Malavasi

[11] 4,233,792

[45] Nov. 18, 1980

[54] PROCESS FOR THE LAYING OF A FLOOR, AND FOR A TILE CLOTHING, AND ELEMENTS FOR THE REALIZATION THEREOF

[76] Inventor: Alberto Malavasi, Piazza Citta Leonina, 9, 00193 Rome, Italy

[21] Appl. No.: 973,389

[22] Filed: Dec. 26, 1978

[51] Int. Cl.[2] ..... E04F 13/08

[52] U.S. Cl. ..... 52/387; 52/477; 52/668

[58] Field of Search ..... 52/476, 477, 384–390, 52/668

[56] References Cited

U.S. PATENT DOCUMENTS

| | | | |
|---|---|---|---|
| 466,741 | 6/1892 | Lanyon | 52/384 |
| 687,501 | 11/1901 | Held | 52/477 |
| 2,199,244 | 4/1940 | Mulford | 52/668 |
| 3,504,472 | 4/1970 | Clement | 52/668 |
| 4,135,338 | 1/1979 | Malavasi | 52/387 |

FOREIGN PATENT DOCUMENTS

| | | | |
|---|---|---|---|
| 579693 | 9/1976 | Switzerland | 52/384 |

*Primary Examiner*—James L. Ridgill, Jr.
*Attorney, Agent, or Firm*—J. Harold Nissen

[57] ABSTRACT

A process, as well as the relative elements therefore, for the realization, in loco, of floors, tile clothings or similar with different materials, or more generally with each material which is adapt for said purposes.

9 Claims, 4 Drawing Figures

Figures 1, 2, 3:
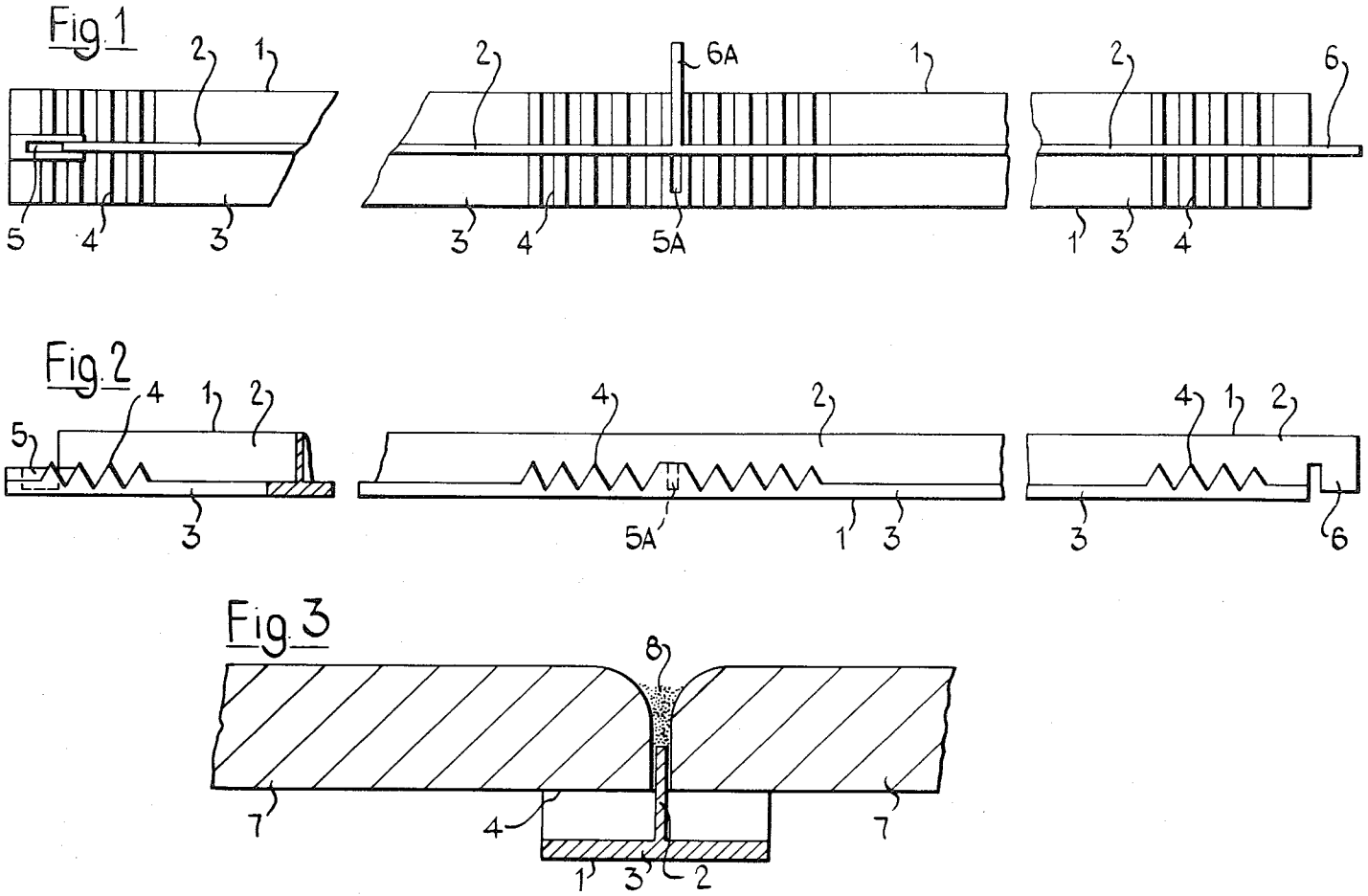

PROCESS FOR THE LAYING OF A FLOOR, AND FOR A TILE CLOTHING, AND ELEMENTS FOR THE REALIZATION THEREOF

The present invention concerns a process, as well as the relative elements therefore, for the realization, in loco, of floors, tile clothings or similar with different materials, or more generally, with each material which is adapted for the aforesaid purposes. The process according to the present invention is possible by means of the utilization of pre-fabricated modular elements, consisting of distancing elements or vertical bands, and by horizontal resting listels. Said modular elements will serve for the composition of a net-like support which will define the seats of the tiles of at least one kind, and said tiles will be inserted without any contact between each other, due to said distancing element or vertical band, which is part of the support means. A horizontal rest- or stop-listel, of appropriate shape, is horizontally connected, at the base thereof and at both sides, to the distancing element or to the vertical band, and onto said listel will rest the edges of the lower part of the tiles. Thus, the perfect disposition of said tiles in elevation will be obtained.

The operations for the preparing of the floor and the relative clothing thereof takes place in successive stages. First, the net-like base support is realized mounting the modular elements onto the surface which is to be covered; further, in the seat of each tile a small amount of grout or other sizing substance will be disposed. Now the tiles are inserted, and said tiles will rest on the horizontal stop listels. Said tiles will result to be separated one from the other by a slit, which slit is due to the vertical distancing element. Said distancing element will be lowered with respect to the plane of the tiles as much as to allow to close said slit according to the actual art.

It is already well known that in the traditional process for clothing floors the tiles were directly fixed, by means of grout or similar material, to the surface to be covered, and that between one tile and the other a space or flight so as to compensate an eventual out-of-gauge of the tiles. In order to adjust the flight, sometimes a list or a distancing element is used between one tile and an other, which will be eliminated after the laying has been completed. Finally, the flight between the tiles will be closed with grout or similar.

Furthermore, the laying of tiles by means of a net-like base support is also well known, said support consisting of modular, pre-fabricated elements and in listels our of wood or other appropriate material (U.S. Pat. No. 4,135,338). In said floors and clothings the modular elements are of such a width as to form a sort of division between one tile and another and, being the upper surface of said elements placed at a lower level that the level of the tiles, said elements have also the function of a base for the sizing of wooden listels or other appropriate material; said listels cover the supports, thus forming a compact or an inlaid work surface.

It is furthermore evident that in the conventional laying of the tiles, the floor or the clothing must be performed by workers skilled in the art, as the tiles are to be placed one after the other without any reference than the one deriving from the matching thereof onto a movable binder.

In the present invention, the net-like base support gives to the tiles the exact position in alignment, as said support defines the seats of the tiles, while horizontal rest-and stop listels give to the tiles the exact position in elevation, thus causing the tiles to automatically form a plane.

In particular, the distancing element or vertical band of the modular element automatically determines the space of flight which has to be left as to annul an eventual out-of-gauge of the tiles, which space will be later closed according to the already well known way, and according to the conventional art.

Furthermore, in the laying of tiles and listels by means of net-like base supports, according to the already well known art (U.S. Pat. No. 4,135,338), an extremely easy mounting of the tiles is obtained, be it through the formation of an exact seat for the tiles, in alignment, be it by means of an exact placing in elevation by means of rest- and stop-elements for the tiles; however, the floor or the clothing thus obtained will result to be a compact or inlaid-work surface.

The process according to the present invention thus shows the advantages, through the particular composition of the floor or clothing being object of said invention, of an easy mounting and of the exactness which can be obtained, by using a net-like base support, as in the process according to U.S. Pat. No. 4,135,338, as well as the obtaining of a surface completely consisting of tiles, as for the traditional method.

The general configuration of the net-like base support is already well known, and has been described in U.S. Pat. No. 4,135,338, as well as, particularly, the possibility of obtaining, by using modular elements with different aggregation points or angles, different kinds of modular net-like supports for the housing of tiles of different shapes; as well, the possibility is already well known of using, instead of modular, rod-shaped elements, other elements, of different shape, but having the same function. Therefore, said elements and said possibilities will not be more particularly described in the present invention.

Figure 4:
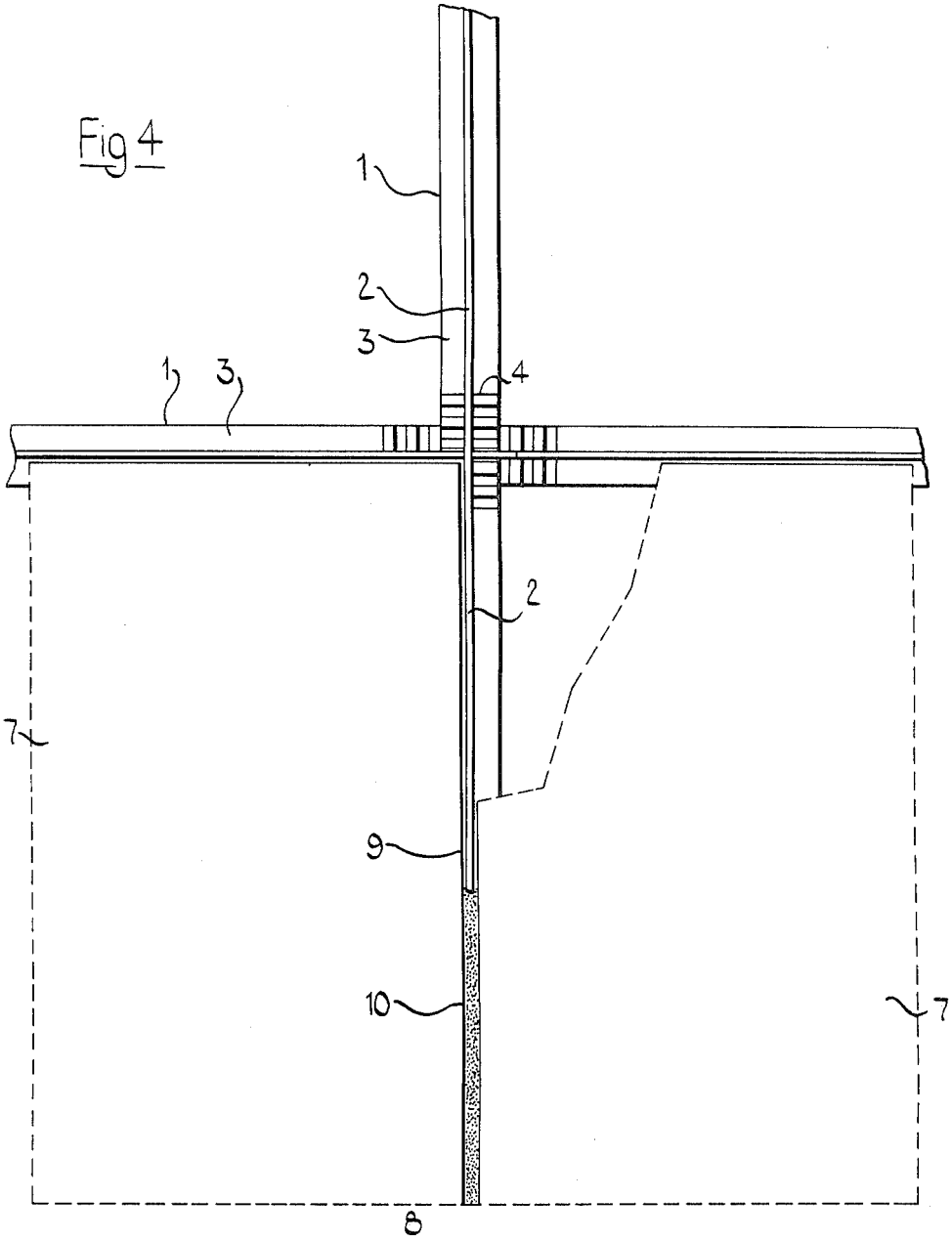

The present invention will be now more evident according to the description referring to the attached drawings, in which the figures show:

FIGS. 1 and 2, an embodiment of a rod-shaped element respectively in a top view and in a lateral view;

FIG. 3, a section of the modular element according to FIG. 1, the floor and the clothing being completed;

FIG. 4, a plan view of a portion of a floor and a clothing, said floor and clothing being realized with the rod-shaped element according to FIGS. 1, 2, 3, with partial sections of some of the elements, and in different stages of the laying process.

In the embodiment according to FIGS. 1, 2 the modular element shown by 1, is rod-shaped, and will be preferably realized by pressing-out of plastic material. Obviously, said modular element may also be obtained in different shapes or materials, but having the same function. Two shows a distancing element, or vertical band, having the function of separating the sides of two tiles. The usual band which mainly has the function of distancing two tiles, will be preferably continuous, as the one according to FIGS. 1, 2, as to serve also to stiffen the modular element, forming a resistance against a flection in the vertical direction. The function of said vertical band being substantially the one of separating the tiles and, together with other bands, of delimiting the seats of the tiles, it is nontheless very important to note that said band may also be discontinuous, i.e. separated into more parts, which in any case must be sufficient, in the number and disposition thereof, to perform the function of said vertical band.

The distancing element, or vertical band 2 is connected to a horizontal listel 3, as to form, together with the same, an up-side-down "T". The upper surface of the horizontal listel, on both sides with respect to the vertical band, will serve over the whole length thereof or along the passages thereof, as a rest and stop for the edge of the lower surface of the tiles. In those points, where the tiles rests at the horizontal listel, the upper face of said listel will be shaped as to show a resting surface provided with corners or points so that an eventual application of grout will not alter the resting plane and therefore the disposition of one tile with respect to the others. In the figures, the resting points projecting above the surface of the listel and are shaped as corners as shown with 4, and said points partially occupy listels 3 in the outer and central part thereof. Obviously, said resting parts could have occupied the whole length of the listel or those parts of the listel which are different from the ones mentioned in the example in the number and disposition thereof, but which are equal in the function. The horizontal listel which has mainly a resting and stopping function for the tiles, will be preferably continuous according to FIGS. 1 and 2, as to serve also to stiffen the modular element, forming a resistance against a flection in the vertical sense. It is very important to note that, in the precedent case, relating to the vertical band, also the horizontal listel may be discontinuous, i.e. separated into more parts, being always sufficient to perform the functions of said listel.

In FIG. 3, 2 shows the distancing element or vertical band, which will be lowered with respect to the upper plane of the tiles. 3 shows horizontal listel, and 4 shows the corner-shaped resting points of said tile 7 to said horizontal listel. Dotted part 8 shows the closing, performed with the conventional art, with grout or any other appropriate material, of the slit or flight between the tiles.

The different stages of the process according to the present invention are shown in FIG. 4, wherein 1 shows the modular element, 2 the vertical band, 3 the horizontal listel, 4 the corner-shaped resting points, 7 parts of the tiles placed onto the net-like base support. In point 9 the tiles are in a side-by-side disposition and separated by band 2, while in point 10 said division or flight is already closed and in said part the clothing is already completed.

Modular element 1 will be provided, at the outer ends thereof, on one side with a tongue-joint 5 and at the other side with a groove-joint 6. In the central part of said modular element on one side vertical band 2, as well as a groove-joint 6A will be provided and on the other side a tongue-joint 5A will be provided. When the top groove- and tongue-joints 6 and 5 of support 1 are connected with the central groove- and tongue-joints 6A and 5A of supports similar with support 1, the net-like base support as shown in FIG. 4 will be obtained.

Obviously, the realization and construction details of the present invention may be largely modified relating to what has been described and illustrated, particularly for what concerns the joints, without therefore going out of the limits of the present invention.

What I claim is:

1. A net-like support structure for use with tiles to facilitate the laying thereof to cover a surface formed from a plurality of modular elements, each of which when connected to another modular element forms the net-like support structure, each of said modular elements comprising:

a horizontal listel;

a vertical band connected with said horizontal listel to form therewith an inverted T-shaped member to hold the tiles in place, said vertical band forming a spacer between adjacent tiles;

said horizontal listel including upper surfaces on both sides of said vertical band to form a stop for the edge of the lower surface of the tiles; and, projecting resting means on said horizontal listel upper surface adapted to receive a material which is also used to hold the tiles to the surface to be covered.

2. The net-like support structure as claimed in claim 1, wherein said vertical band is continuous.

3. The net-like support structure as claimed in claim 1, wherein said vertical band is discontinuous.

4. The net-like support as claimed in claim 1, wherein said resting means includes resting points at each of the ends of each said horizontal listel to form cover grout receiving areas beneath the tiles and to provide for a spacing between the tiles and said upper surfaces for receiving grout thereby permitting the leveling of the top surface of the tiles to form a plane surface regardless of the condition of the surface being covered.

5. The net-like support as claimed in claim 4, wherein said horizontal listel and said vertical band are rod-shaped and pressed out of plastic material, and said resting means also includes resting points intermediate the ends of each said horizontal listel.

6. The net-like support structure as claimed in claim 1, including a tongue and groove joint, each said vertical band including a tongue joint at one end and a groove joint at the other end of said modular element.

7. The net-like support structure as claimed in claim 1 or 6, including a tongue and groove joint between the ends of each said vertical band, said tongue and groove joint including a tongue joint on one side of said vertical band and a groove joint on the other side of said vertical band.

8. The net-like support structure as claimed in claim 1, wherein said modular elements when connected form a net-like base support for the laying of tiles, said upper surfaces of each said horizontal listel cooperating to form a plane for the tiles as they rest on the horizontal listel of each of said modular elements, and said vertical band separates adjacent tiles from each other to provide a space for grout to be received and to take care of any tiles which are out-of-gauge.

9. The net-like support as claimed in claim 8, wherein the height of said vertical band is less than the tile height used with the modular elements.

* * * * *